US011448419B2

(12) United States Patent
Kang et al.

(10) Patent No.: US 11,448,419 B2
(45) Date of Patent: Sep. 20, 2022

(54) AIR CONDITIONER

(71) Applicant: SAMSUNG ELECTRONICS CO., LTD., Suwon-si (KR)

(72) Inventors: Yong Hun Kang, Seoul (KR); Jin Baek Kim, Hwaseong-si (KR); Seong Hyun Yoon, Seoul (KR); Eung Ryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 119 days.

(21) Appl. No.: 16/756,728

(22) PCT Filed: Oct. 15, 2018

(86) PCT No.: PCT/KR2018/012139
§ 371 (c)(1),
(2) Date: Apr. 16, 2020

(87) PCT Pub. No.: WO2019/078565
PCT Pub. Date: Apr. 25, 2019

(65) Prior Publication Data

US 2021/0190370 A1 Jun. 24, 2021

(30) Foreign Application Priority Data

Oct. 16, 2017 (KR) ..... 10-2017-0133855

(51) Int. Cl.
*F24F 13/10* (2006.01)

(52) U.S. Cl.
CPC ..... *F24F 13/10* (2013.01)

(58) Field of Classification Search
CPC ..... F24F 13/10; F24F 13/14; F24F 13/1413; F24F 1/0057; F24F 13/142; F24F 13/1426; F04D 25/088
See application file for complete search history.

(56) References Cited

U.S. PATENT DOCUMENTS

2004/0007002 A1 1/2004 Asami et al.

FOREIGN PATENT DOCUMENTS

CN 1906447 A 1/2007
CN 101178199 A 5/2008
(Continued)

OTHER PUBLICATIONS

English Translation of JP-2001304674-A—Translated Nov. 19, 2021 (Year: 2021).*

(Continued)

*Primary Examiner* — Edelmira Bosques
*Assistant Examiner* — Brett Peterson Mallon
(74) *Attorney, Agent, or Firm* — Staas & Halsey LLP

(57) ABSTRACT

The present disclosure relates to an air conditioner capable of inducing airflow blown through a blowing port to blow in a substantially horizontal direction. The air conditioner includes a housing including a blowing port, and an airflow guide unit installed in the blowing port to be rotatable about a rotation shaft, wherein the airflow guide unit includes a main blade configured to cover the blowing port, and a pair of sub blades spaced downwardly apart from the main blade and disposed in a flow passage of the blowing port such that outer surfaces thereof are in contact with airflow in the blowing port as a whole, and having different inclination angles.

8 Claims, 9 Drawing Sheets

(56) References Cited

FOREIGN PATENT DOCUMENTS

| | | | | | |
|---|---|---|---|---|---|
| CN | 105180267 | | | 12/2015 | |
| CN | 206073390 | U | | 4/2017 | |
| EP | 1707893 | | | 10/2006 | |
| EP | 2327938 | | | 6/2011 | |
| EP | 3124887 | A1 | * | 2/2017 | ..... F24F 1/0011 |
| JP | 10-332191 | | | 12/1998 | |
| JP | 2001304674 | A | * | 10/2001 | |
| JP | 2002-61944 | | | 2/2002 | |
| JP | 2007-132578 | | | 5/2007 | |
| JP | 2009-85448 | | | 4/2009 | |
| JP | 2014-16132 | | | 1/2014 | |
| KR | 10-0736002 | | | 7/2007 | |
| KR | 10-2008-0035946 | | | 4/2008 | |
| KR | 10-2008-0055454 | | | 6/2008 | |
| KR | 10-2012-0041222 | | | 4/2012 | |

OTHER PUBLICATIONS

Extended European Search Report dated Jul. 28, 2020 from European Application No. 18868456.7, 7 pages.
Chinese Office Action for corresponding Chinese Patent Application No. 201880067282.3 dated Mar. 25, 2021.
Korean Office Action dated Jun. 7, 2022 from Korean Application No. 10-2017-0133855.

* cited by examiner

【Fig. 4】
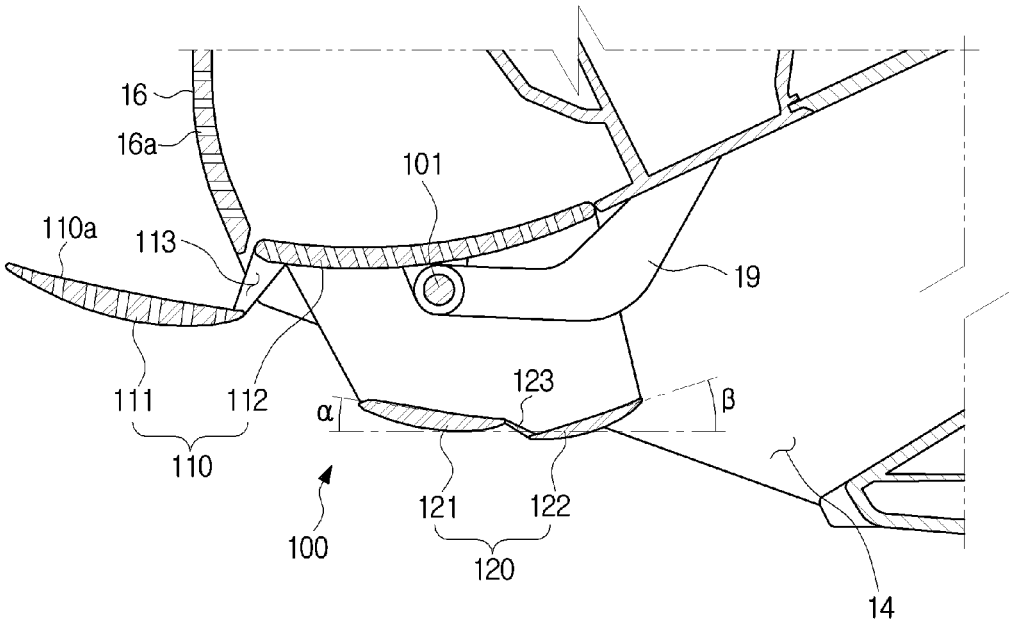

【Fig. 5】
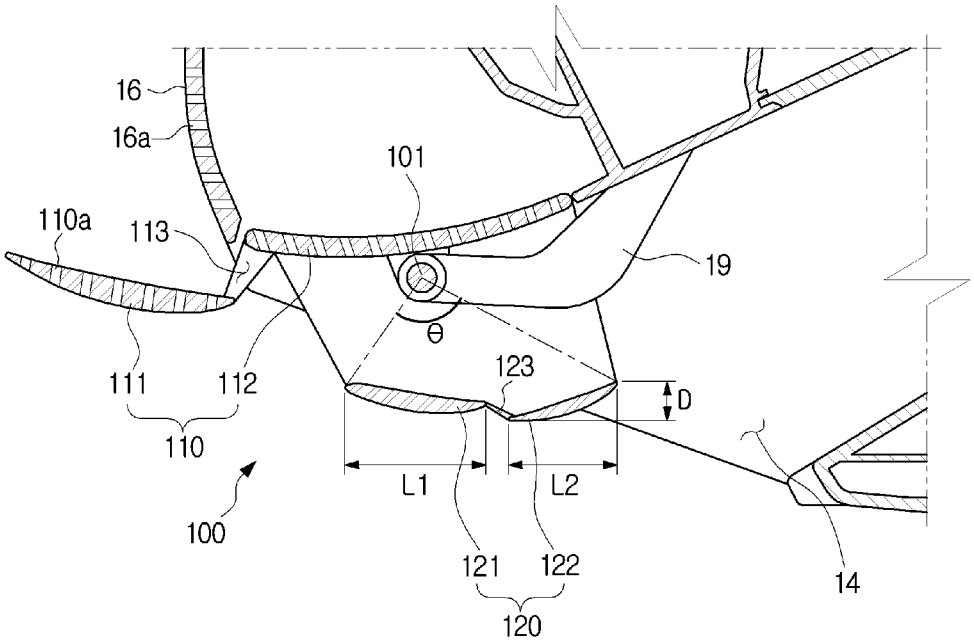

【Fig. 6】
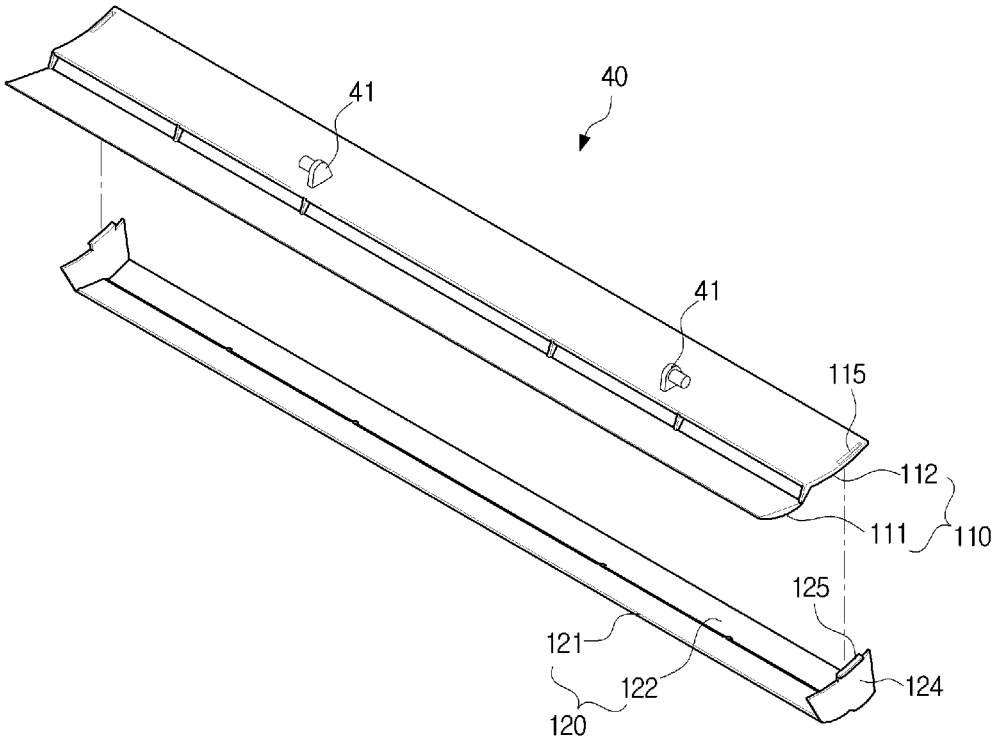

【Fig. 7】
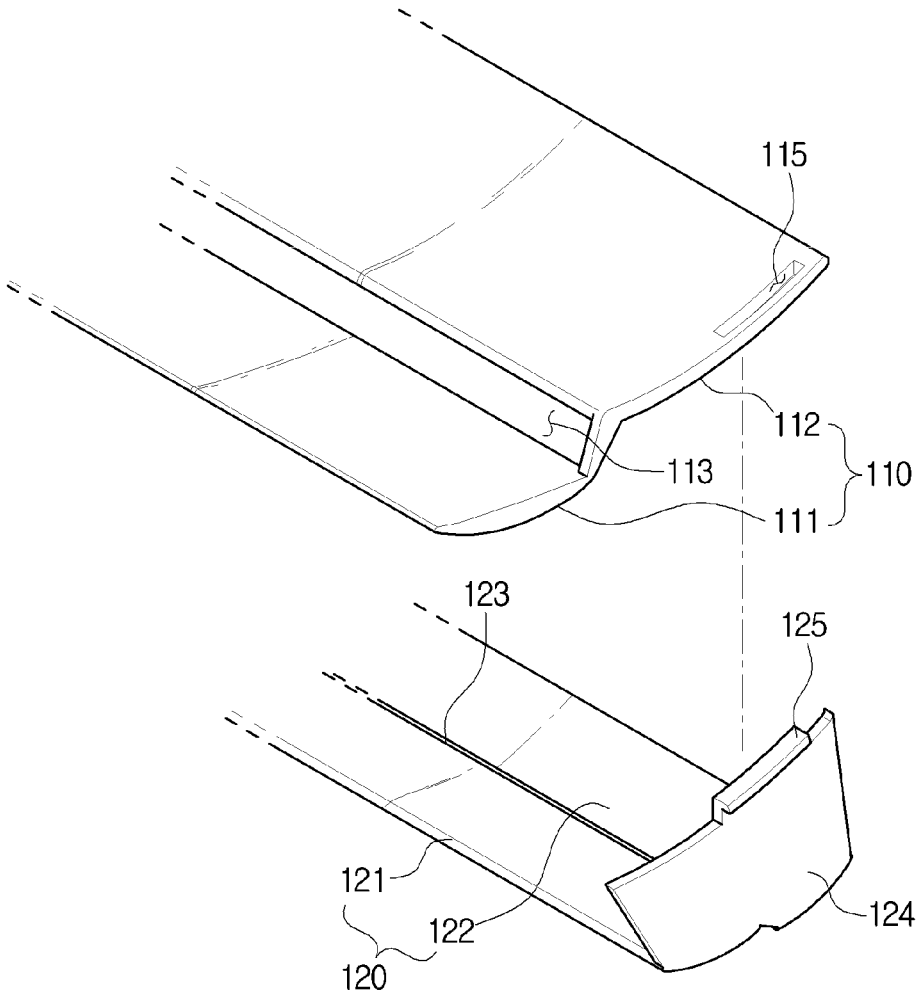

【Fig. 8】
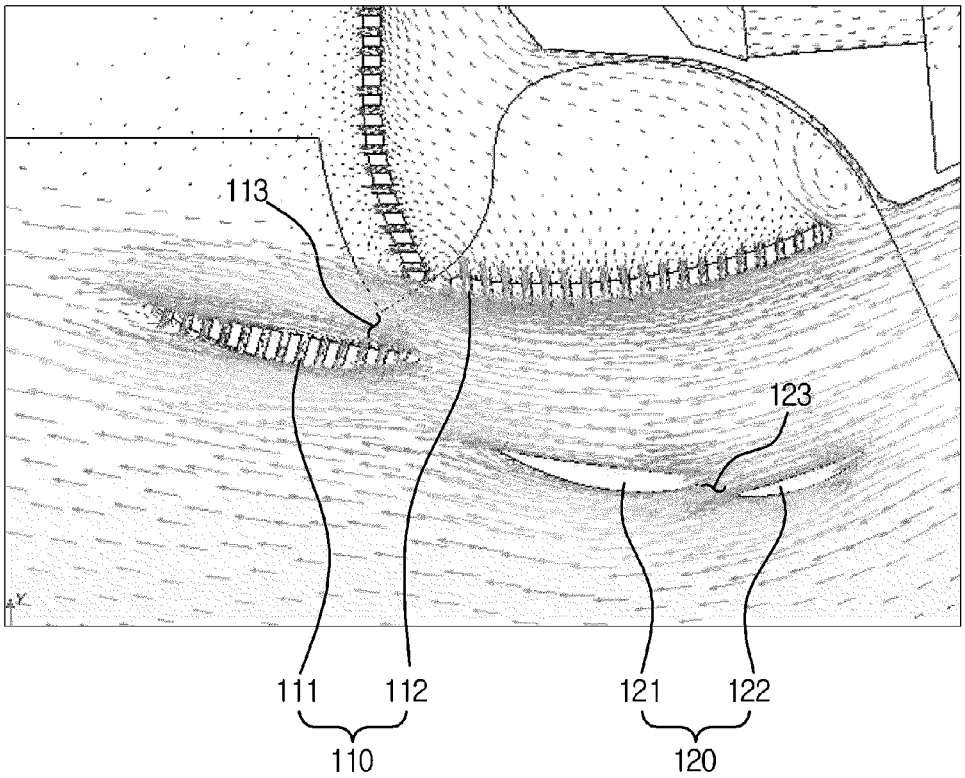

【Fig. 9】
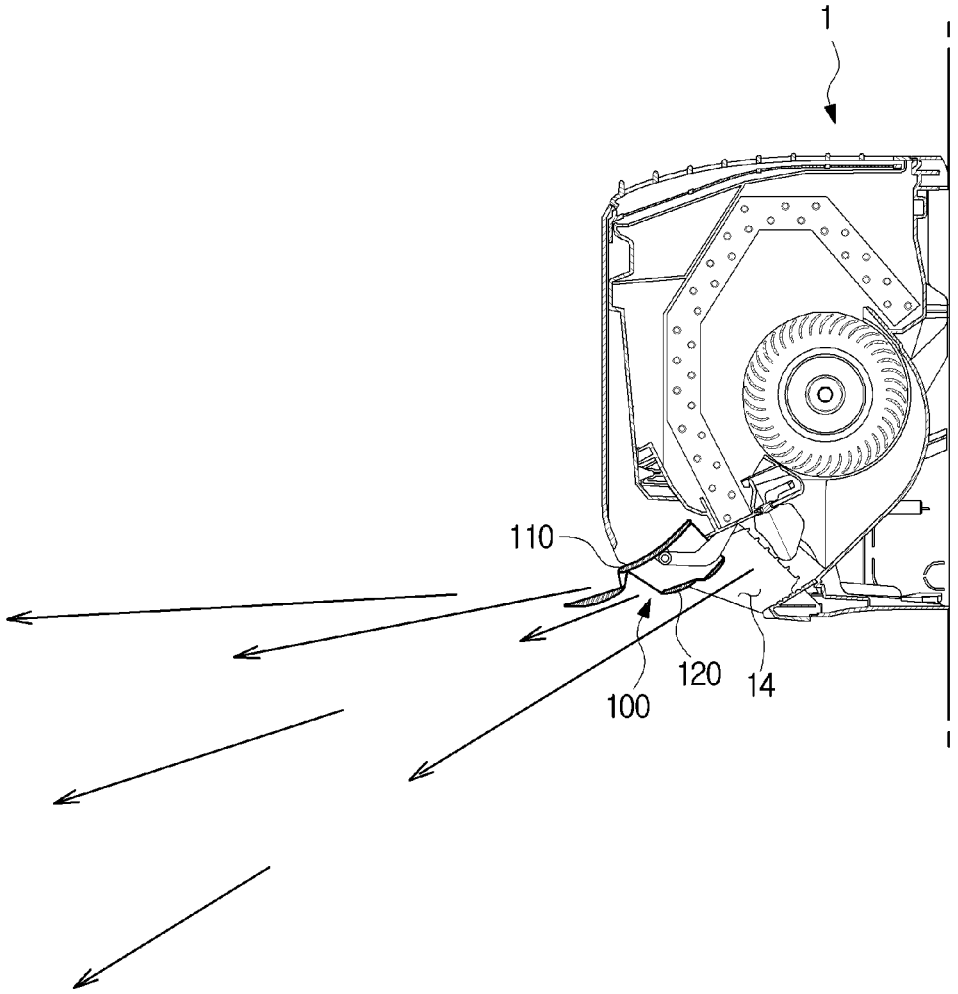

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/012139 filed on Oct. 15, 2018, which claims foreign priority benefit under 35 U.S.C. § 119 of Korean Patent Application No. 10-2017-0133855 filed on Oct. 16, 2017 in the Korean Intellectual Property Office, the contents of both of which are incorporated herein by reference.

TECHNICAL FIELD

The present disclosure relates to an air conditioner including an airflow guide unit for guiding airflow blown through a blowing port.

BACKGROUND ART

In general, an air conditioner is a device that removes dust in air while controlling temperature, humidity, airflow, and distribution suitable for human activity using a refrigeration cycle. The refrigeration cycle is composed of a compressor, a condenser, an evaporator, a blowing fan, and the like as main components.

The air conditioner may be classified into a separate type of air conditioner in which an indoor unit and an outdoor unit are separately installed, and an integrated air conditioner in which the indoor unit and the outdoor unit are installed together in one cabinet. The indoor unit of the separate type air conditioner includes a heat exchanger for heat-exchanging air sucked into a panel, a blowing fan for sucking air in a room into the panel and blowing the sucked air back into the room, and a blowing port for discharging airflow generated by the blowing fan.

The airflow blown through the blowing port allows the room to be cooled or heated. At this time, the direction and speed of the airflow not only affect the speed of temperature change in indoor regions and the temperature difference in the indoor regions, but also affect a user's emotion through the airflow.

DISCLOSURE

Technical Problem

The present disclosure is directed to providing an air conditioner capable of inducing airflow blown through a blowing port to blow in a substantially horizontal direction.

The present disclosure is directed to providing an air conditioner capable of minimizing frictional flow losses in inducing a direction of airflow blown through the blowing port.

The present disclosure is directed to providing an air conditioner capable of controlling direction and velocity of airflow.

Technical Solution

The present disclosure provides an air conditioner including a housing further including a blowing port, and an airflow guide unit installed in the blowing port to be rotatable about a rotation shaft, wherein the airflow guide unit includes a main blade configured to cover the blowing port, and a pair of sub blades spaced downwardly apart from the main blade and disposed in a flow passage of the blowing port such that outer surfaces thereof are in contact with airflow in the blowing port as a whole, and having different inclination angles.

The sub blades may include a first sub blade disposed in the blowing port in a state in which the main blade opens the blowing port, and a second sub blade disposed in the rear of the first sub blade.

The first sub blade may have a longer horizontal length than the second sub blade.

The first sub blade may be disposed to be inclined upward toward the front, and the second sub blade may be disposed to be inclined downward toward the front.

The first sub blade may be disposed to be inclined 15 to 20 degrees with respect to a horizontal direction.

The second sub blade may be disposed to be inclined 7 to 12 degrees with respect to a horizontal direction.

The sub blade may be formed in a range of a center angle of 100 to 120 degrees about the rotation shaft.

The sub blade may be formed to have a vertical thickness of 11 to 21 mm.

The main blade may include a plurality of fine discharge ports to allow airflow to be discharged in a state of covering the blowing port.

The main blade may include a first main blade disposed in the front of the blowing port in a state of opening the blowing port, and a second main blade disposed in the rear of the first main blade.

The main blade and the sub blade may be detachably coupled.

Another aspect of the present disclosure provides an air conditioner including a housing including a blowing port, and a pair of blades disposed in the blowing port to have different inclination angles with respect to a horizontal direction in order to guide airflow blown through the blowing port toward the horizontal direction in a state in which an outer surface thereof is in contact with the airflow in the blowing port as a whole.

The blades may include a first blade disposed to be inclined upward toward the front, and a second blade disposed to be inclined downward toward the front.

The first blade may be disposed in the front of the second blade.

The first blade may have a longer horizontal length than the second blade.

The first blade may be disposed to be inclined 16 to 18 degrees with respect to the horizontal direction, and the second blade may be disposed to be inclined 9 to 11 degrees with respect to the horizontal direction.

Another aspect of the present disclosure provides an air conditioner including a housing forming an appearance, a blowing port provided at a lower portion of the housing, a suction port provided at an upper portion of the housing, a first blade disposed to be inclined upward toward the front, and a second blade disposed to be spaced apart from the rear of the first blade and to be inclined downward toward the front.

The first blade may have a longer horizontal length than the second blade.

The first blade and the second blade may be configured to have a cross section of an airfoil shape.

The first blade and the second blade may be configured to have a curved cross-sectional shape convex downward.

Advantageous Effects

Because airflow can be blown in a substantially horizontal direction through a blowing port, cold air does not reach a user directly so that the discomfort that the user may feel due to the cold air can be minimized, and blowing distance of airflow can increase so that the room temperature can quickly reach to a desired heating and cooling temperature.

DESCRIPTION OF DRAWINGS

FIG. 4 is an enlarged view of the airflow guide unit in FIG. 3.

FIG. 5 is an enlarged view of the airflow guide unit in FIG. 3.

FIG. 6 is an exploded perspective view of the airflow guide unit according to an embodiment of the present disclosure.

FIG. 7 is an enlarged view of coupling portions of a main blade and a sub blade in FIG. 6.

FIG. 8 is a cross-sectional view taken along line A-A' in FIG. 1 illustrating a flow analysis result around the airflow guide unit in a state in which airflow is induced by the airflow guide unit according to an embodiment of the present disclosure.

FIG. 9 is a cross-sectional view taken along line A-A' in FIG. 1 illustrating a state in which airflow is induced downward by the airflow guide unit according to an embodiment of the present disclosure.

MODE OF THE INVENTION

Figure 1:
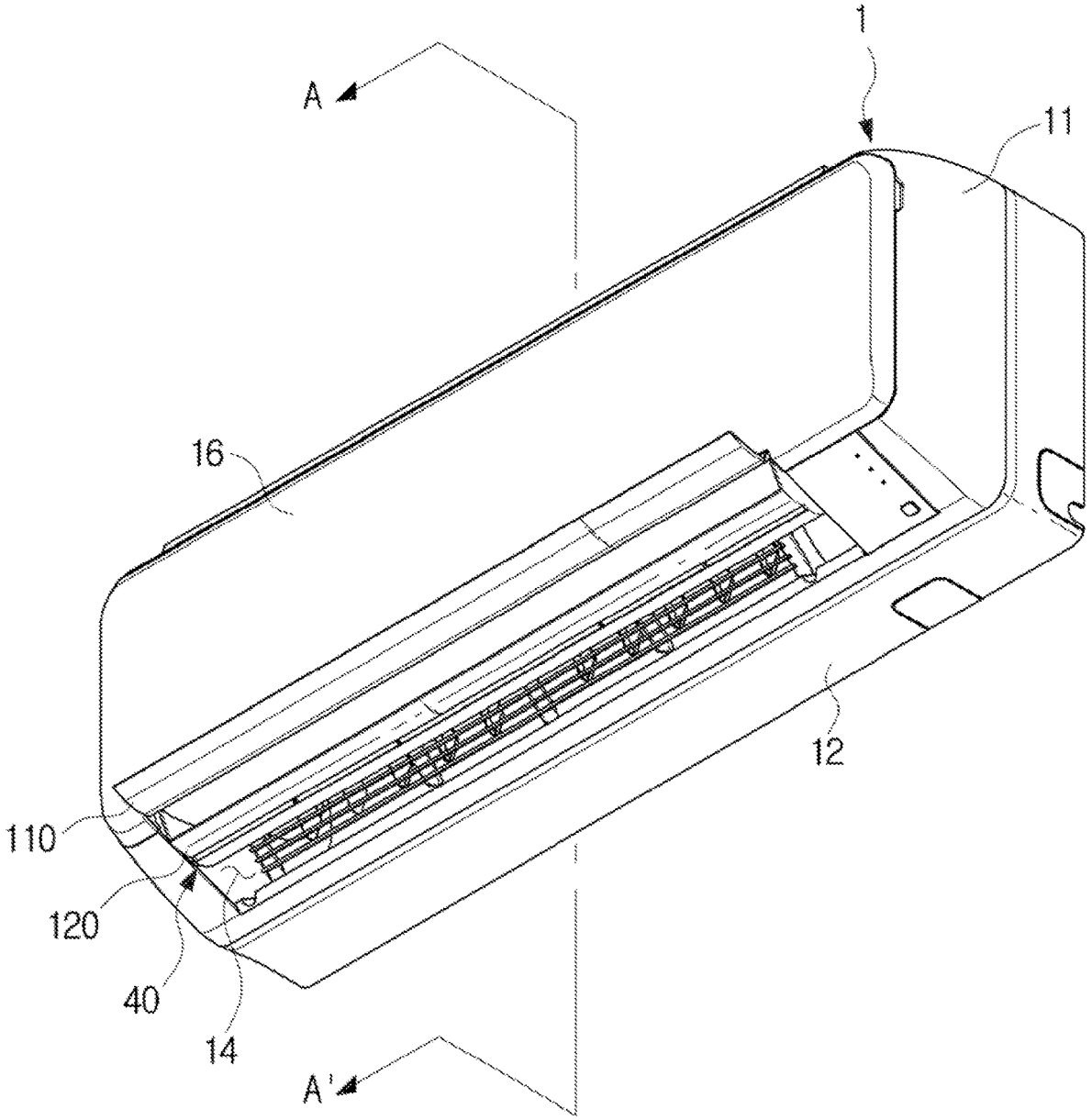
FIG. 1 is a perspective view illustrating an appearance of an air conditioner according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

In this specification, the term "front" may indicate a direction in which is air is discharged, and the term "rear" may indicate a direction opposite to "front".

In this specification, the term "horizontal direction" may indicate "front-rear direction".

Hereinafter, embodiments of the present disclosure will be described in detail with reference to the accompanying drawings.

A refrigeration cycle of an air conditioner is composed of a compressor, a condenser, an expansion valve, and an evaporator. A refrigerant undergoes a series of processes consisting of compression, condensation, expansion, and evaporation, and a high temperature air is exchanged with a low temperature refrigerant to become a low temperature air and supplied to a room.

The compressor compresses and discharges a refrigerant gas at high temperature and high pressure, and the discharged refrigerant gas is introduced into the condenser. The condenser condenses the compressed refrigerant into a liquid phase and releases heat to surroundings through the condensation process. The expansion valve expands a high temperature and high pressure liquid refrigerant condensed in the condenser into a low pressure liquid refrigerant. The evaporator evaporates the refrigerant expanded in the expansion valve. The evaporator uses the latent heat of evaporation of a refrigerant to achieve a cooling effect by heat exchange with an object to be cooled, and returns a low temperature and low pressure refrigerant gas to the compressor. Through this cycle, an air temperature of an indoor space may be controlled.

An outdoor unit of the air conditioner refers to a device consisting of a compressor and an outdoor heat exchanger in a refrigeration cycle. An expansion valve may be disposed in either an indoor unit or an outdoor unit of an air conditioner, and an indoor heat exchanger is disposed in the indoor unit.

The present disclosure relates to an air conditioner cooling an indoor space, and the outdoor heat exchanger functions as a condenser and the indoor heat exchanger functions as an evaporator. Hereinafter, for convenience, an indoor unit including an indoor heat exchanger is referred to as an air conditioner, and the indoor heat exchanger is referred to as a heat exchanger.

Figure 2:
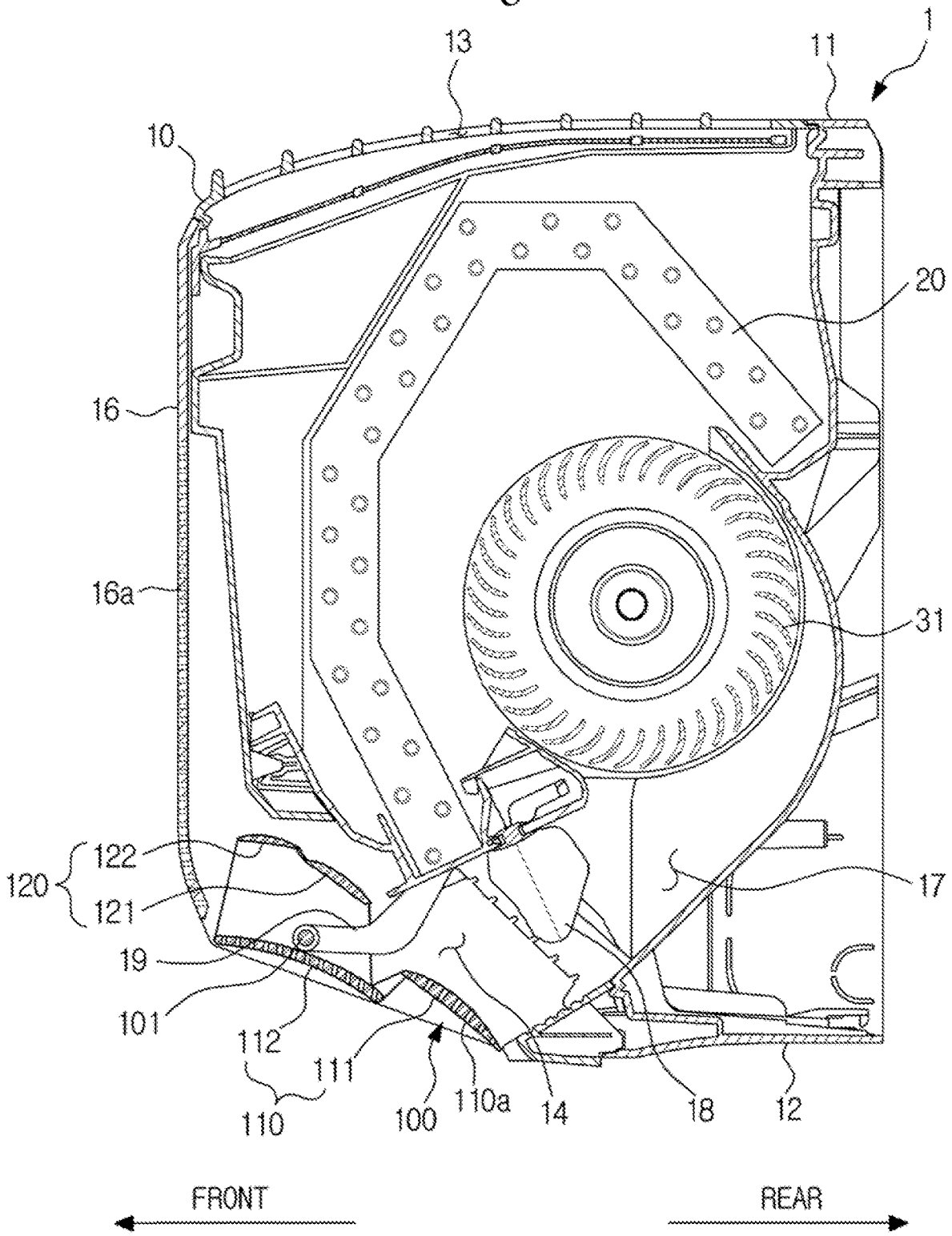
FIG. 2 is a cross-sectional view taken along line A-A' in FIG. 1 illustrating a state in which an airflow guide unit of the air conditioner according to an embodiment of the present disclosure covers a blowing port.
Figure 3:
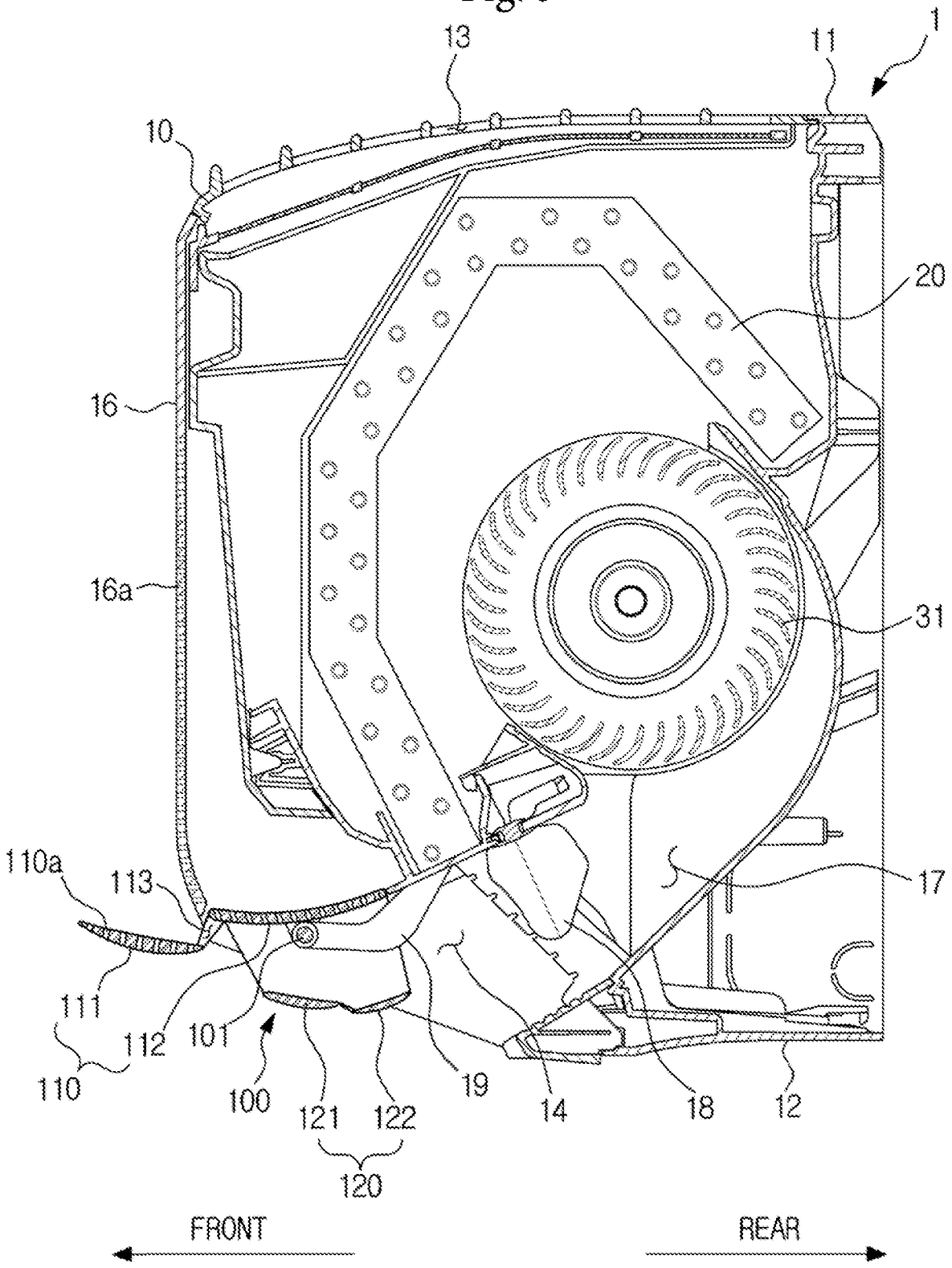
FIG. 3 is a cross-sectional view taken along line A-A' in FIG. 1 illustrating a state in which airflow is guided forward by the airflow guide unit of the air conditioner according to an embodiment of the present disclosure.

FIG. 1 is a perspective view illustrating an appearance of an air conditioner according to an embodiment of the present disclosure. FIG. 2 is a cross-sectional view illustrating a state in which an airflow guide unit of the air conditioner according to an embodiment of the present disclosure covers a blowing port. FIG. 3 is a cross-sectional view illustrating a state in which airflow is guided forward by the airflow guide unit of the air conditioner according to an embodiment of the present disclosure. FIGS. 4 and 5 illustrate structural features of the airflow guide unit of the air conditioner according to an embodiment of the present disclosure.

As illustrated in FIGS. 1 to 5, an air conditioner 1 may include a housing 10 having a suction port 13 and a blowing port 14, a heat exchanger 20 disposed inside the housing 10 to exchange heat with air introduced into the housing 10, and a blowing fan 31 sucking air into the housing 10 and flowing the sucked air toward the blowing port 14.

The housing 10 may include a housing body 11 having a substantially rectangular parallelepiped shape, a front panel 16 forming a front surface of the housing 10, and a lower cover 12 capable of being opened downward.

The suction port 13 may be provided at an upper portion of the housing 10, and the blowing port 14 may be provided at a lower portion of the housing 10.

The air conditioner 1 may configured to be fixed to a wall surface. Specifically, the housing body 11 may be fixed to a wall surface.

The front panel 16 may be provided with a fine discharge port 16*a* to allow air to be discharged at a very low speed. Because the fine discharge port 16*a* is formed of holes of very small size so that airflow transferred to the front panel 16 from the inside of the housing 10 has a very low flow velocity in the process of passing through the fine discharge port 16*a*, the airflow discharged through the front panel 16 may not be recognized by a user.

The lower cover 12 is configured to be opened and closed downward even after the housing body 11 is fixed to the wall surface, so that a pipe or a power line may be easily connected in the installation of the air conditioner 1.

The blowing fan 31 may be a cross flow fan such as a sirocco fan, a blowing passage 17 may be provided below the blowing fan 31 to guide air discharged from the blowing fan 31, and air passed through the blowing passage 17 may be discharged to the outside through the blowing port 14.

The blowing passage 17 may be provided with a louver 18 for guiding the switching of the discharged airflow in the left and right directions.

An airflow guide unit 100 may be disposed in the blowing port 14 to guide airflow to be discharged. The airflow guide unit 100 may be rotatably installed about a rotation shaft 101.

The airflow guide unit 100 may be rotatably supported as the rotation shaft 101 is coupled to the support 19 and may be configured to be driven by a motor (not shown) to enable forward and reverse rotations in clockwise and counter-clockwise directions.

As illustrated in FIG. 2, the airflow guide unit 100 may include a main blade 110 configured to cover the blowing port 14, and a sub blade 120 configured to guide airflow to a horizontal direction through the blowing port 14 in a state in which the airflow guide unit 100 opens the blowing port 14.

The main blade 110 may be provided with a fine discharge port 111 as in the front panel 16. Accordingly, even when the main blade 110 covers the blowing port 14, airflow may be discharged at a very low speed through the fine discharge port 16*a* of the front panel 16 and the fine discharge port 110*a* of the main blade 110.

When the discharge of airflow in the horizontal direction through the blowing port 14 is required, as illustrated in FIG. 3, the airflow guide unit 100 may be arranged to open the blowing port 14 by rotating in the clockwise direction.

As illustrated in FIG. 3, in a state in which the airflow guide unit 100 opens the blowing port 14, the main blade 110 may be disposed to direct the front. The main blade 110 may include a first main blade 111 disposed in the front of the blowing port and a second main blade 112 disposed in the rear of the first main blade 111.

The first main blade 111 may be disposed to be slightly inclined upward with respect to a horizontal plane so that the airflow passed through the blowing port 14 may be induced to direct the front.

The second main blade 112 may be arranged to form an upper portion of the blowing port 14 so that the airflow may be guided to direct the front.

The first main blade 111 and the second main blade 112 may be disposed to be spaced apart from each other in the horizontal direction, and a flow passage 113 through which airflow may pass may be formed between the first main blade 111 and the second main blade 112.

The airflow guide unit 100 may further include the sub blade 120 disposed to be spaced downwardly from the main blade 110.

The sub blade 120 may include a pair of a first sub blade 121 and a second sub blade 122 disposed to be spaced apart from each other. The second sub blade 122 may be disposed in the rear of the first sub blade 121.

The first sub blade 121 and the second sub blade 122 may be disposed to have different inclination angles with respect to the horizontal direction. Specifically, the first sub blade 121 may be disposed to be slightly inclined upward toward the front, and the second sub blade 122 may be disposed to be slightly inclined downward toward the front.

More specifically, the first sub blade 121 may be disposed to be inclined within an angle range of 15 to 20 degrees with respect to the horizontal plane, and the second sub blade 122 may be disposed to be inclined within an angle range of 7 to 12 degrees with respect to the horizontal plane.

According to an embodiment illustrated, the first sub blade 121 may be disposed to be inclined at about 17 degrees with respect to the horizontal plane, and the second sub blade 122 may be disposed to be inclined at about 10 degrees with respect to the horizontal plane.

The first sub blade 121 and the second sub blade 122 may be disposed to be spaced apart from each other in the horizontal direction, and a flow passage 123 through which airflow may pass may be formed between the second sub blade 121 and the second sub blade 122.

The sub blade 120 may have an appropriate size and structural shape to induce the movement of airflow in the horizontal direction.

According to an embodiment, the first sub blade 121 may be provided to have a horizontal length L1 longer than a horizontal length L2 of the second sub blade 122.

According to an embodiment, the sub blade 120 may be formed in a range of a center angle θ of 100 to 120 degrees about the rotation shaft 41 of the airflow guide unit 40 as a whole, and thus may be provided to have a horizontal length corresponding to the center angle θ.

According to an embodiment, the sub blade 120 may be formed in a range of the center angle θ of 110 degrees about the rotation shaft 41 of the airflow guide unit 40, and thus may have a horizontal length corresponding to the center angle θ.

According to an embodiment, the sub blade 120 may be formed to have a vertical thickness D of 11 to 21 mm.

According to an embodiment, the sub blade 120 may be formed to have the vertical thickness D of 16 mm.

According to an embodiment, the sub blade 120 may be formed in a range of the center angle θ of 100 to 120 degrees about the rotation shaft 41 of the airflow guide unit 40.

According to an embodiment, the sub blade 120 may be formed in a range of the center angle θ of 110 degrees about the rotation shaft 41 of the airflow guide unit 40.

In addition, the first sub blade 121 and the second sub blade 122 may be provided to have a cross section of an airfoil shape as a whole, and may be disposed to be in contact with airflow in the blowing port. Therefore, the first sub blade 121 and the second sub blade 122 may guide the airflow through the entire outer surface including upper and lower surfaces.

In addition, the first sub blade 121 and the second sub blade 122 may be provided to have a curved cross-sectional shape convex downward.

FIG. 6 is an exploded perspective view of the airflow guide unit according to an embodiment of the present disclosure, and FIG. 7 is an enlarged view of coupling portions of a main blade and a sub blade in FIG. 6.

The airflow guide unit 40 may be configured by including a main blade 110 and a sub blade 120 as described above, or the main blade 110 and the sub blade 120 may be integrally configured through coupling in a separately provided state as illustrated in the drawings.

According to an embodiment, a locking hook 125 protruding upward may be provided on an upper portion of opposite side surfaces 124 of the sub blade 120 for coupling the main blade 110 and the sub blade 120, and a corresponding locking groove 115 may be provided at opposite ends of the second main blade 112 of the main blade 110.

Therefore, the main blade 110 and the sub blade 120 may be coupled by a coupling force between the locking hook 125 and the locking groove 115 as the locking hook is inserted into the locking groove. Because coupling by the locking hook 125 and the locking groove 115 may be released by detaching the locking hook 125 from the locking groove 115, the main blade 110 and the sub blade 120 may be detachably coupled.

The coupling structure and coupling method between the main blade 110 and the sub blade 120 as described above are just one example, and the present disclosure is not limited thereto. For example, an adhering portion between the main blade 110 and the sub blade 120 may be adhered by an adhesive or may be adhered by heating and fusion by ultrasonic waves and the like.

FIG. 8 is a view illustrating a flow analysis result around the airflow guide unit in a state in which airflow is induced by the airflow guide unit according to an embodiment of the present disclosure.

According to an embodiment, it may be seen that airflow flows quickly along a periphery of the sub blade 120 by the Coanda effect without the occurrence of flow separation around the sub blade 120. Therefore, the airflow may be induced upward while minimizing the airflow loss before and after the passage of the sub blade 120, and this may increase blowing distance of the airflow and reduce blowing noise.

In the case of inducing airflow to change a direction of the airflow by colliding a surface of the blade with the airflow, flow separation occurs along the surface of the blade, which increases the flow resistance, thereby increasing the airflow loss and blowing noise. However, according to the airflow guide unit 100 according to an embodiment of the present disclosure, because the first main blade 111 and the sub blade 120 having an airfoil-shaped cross section is disposed on the flow passage of the blowing port 14 so that the airflow may be induced upward while the flow separation is suppressed to the maximum by a shape difference between the upper and lower surfaces in a state where the outer surface thereof is in contact with the airflow as a whole, the blowing distance of the airflow may increase and the blowing noise may be reduced, compared to the case of inducing airflow to change a direction of the airflow by colliding a surface of the blade with the airflow.

FIG. 9 is a view illustrating a state in which airflow is induced downward by the airflow guide unit according to an embodiment of the present disclosure.

As illustrated in FIG. 9, the air conditioner 1 according to an embodiment of the present disclosure may be a combined type of cooling and heating capable of performing both a cooling operation and a heating operation. The airflow guide unit 100 of the air conditioner 1 may be disposed in the blowing port 14 of the air conditioner 1 to guide airflow to be discharged.

The structure and method of inducing airflow upward through the airflow guide unit 100 in the cooling operation are the same as the above-described embodiment.

In the heating operation, because the temperature of airflow is higher than that of the surrounding air and thus the discharged airflow tends to direct upward, it may be advantageous to induce the airflow downward than in the cooling operation.

As illustrated in FIG. 9, when the airflow guide unit 100 is slightly rotated counterclockwise from a cooling operation position in the heating operation, airflow may be induced downward by the main blade 110 and the sub blade 120. Therefore, according to an embodiment of the present disclosure, the airflow guide unit 100 may be applied to the heating operation. In addition, because airflow is induced along the outer surfaces of the main blade 110 and the sub blade 120 even in the heating operation, the blowing distance of the airflow may increase and the blowing noise may be reduced.

While the present disclosure has been particularly described with reference to exemplary embodiments, it should be understood by those of skilled in the art that various changes in form and details may be made without departing from the spirit and scope of the present disclosure.

The invention claimed is:

1. An air conditioner comprising:

a housing comprising a blowing port; and an airflow guide unit installed in the blowing port to be rotatable about a rotation shaft, wherein the airflow guide unit comprises:

a pair of main blades configured to be rotatable between a first position for closing the blowing port and a second position for opening the blowing port; and a pair of sub blades spaced downwardly apart from the main blades and disposed in a flow passage of the blowing port such that outer surfaces thereof are in contact with airflow in the blowing port, and having different inclination angles, wherein the main blades comprise a first main blade disposed in the front of the blowing port, and a second main blade disposed in the rear of the first main blade when the main blades are in the second position, wherein a rear end of the first main blade is disposed in front of a front end of the second main blade when the main blades are in the second position, wherein the sub blades comprise a first sub blade disposed in the blowing port and a second sub blade disposed in the rear of the first sub blade when the main blades are in the second position, wherein a rear end of the first sub blade is disposed in front of a front end of the second sub blade when the main blades are in the second position, and wherein the first sub blade is disposed to be inclined upward toward the front, and the second sub blade is disposed to be inclined downward toward the front when the main blades are in the second position.

2. The air conditioner according to claim 1, wherein an extension length of the first sub blade along an airflow discharge direction is longer than an extension length of the second sub blade along the airflow discharge direction.

3. The air conditioner according to claim 1, wherein the first sub blade is disposed to be inclined 15 to 20 degrees with respect to an airflow discharge direction.

4. The air conditioner according to claim 1, wherein the second sub blade is disposed to be inclined 7 to 12 degrees with respect to an airflow discharge direction.

5. The air conditioner according to claim 1, wherein an angle between a first imaginary line connecting the rotating shaft to a front end of the first sub blade and a second imaginary line connecting the rotating shaft to a rear end of the second sub blade is in a range of 100 to 120 degrees.

6. The air conditioner according to claim 1, wherein each of the sub blades is formed to have a vertical thickness of 11 to 21 mm.

7. The air conditioner according to claim 1, wherein each of the main blades comprises a plurality of fine discharge ports to allow airflow to be discharged when the main blades are in the first position.

8. The air conditioner according to claim 1, wherein the main blades and the sub blade are detachably coupled.

* * * * *